US005855177A

United States Patent [19]

Nakayama et al.

[11] Patent Number: 5,855,177

[45] Date of Patent: Jan. 5, 1999

[54] PRESSER REGULATING THUMB SCREW DEVICE OF A SEWING MACHINE

[75] Inventors: Koichi Nakayama; Shinji Kojima, both of Utsunomiya, Japan

[73] Assignee: The Singer Company N.V., Curaco, Netherlands

[21] Appl. No.: 711,212

[22] Filed: Sep. 10, 1996

[30] Foreign Application Priority Data

Sep. 14, 1995 [JP] Japan ..... 7-262489

[51] Int. Cl.[6] ..... D05B 29/00

[52] U.S. Cl. ..... 112/235

[58] Field of Search ..... 112/235, 236, 112/237, 238; 411/395, 396, 510

[56] References Cited

U.S. PATENT DOCUMENTS

| | | | |
|---|---|---|---|
| 2,405,412 | 8/1946 | Eby | 411/396 |
| 2,419,494 | 4/1947 | Knaus | 112/237 X |
| 4,274,350 | 6/1981 | Walter et al. | 112/235 |
| 4,630,557 | 12/1986 | Russell | 112/235 |
| 5,456,685 | 10/1995 | Huebner | 411/395 X |

FOREIGN PATENT DOCUMENTS 601949 7/1960 Canada .

*Primary Examiner*—Ismael Izaguirre

*Attorney, Agent, or Firm*—McCormick, Paulding & Huber

[57] ABSTRACT

A presser regulating thumb screw device of a sewing machine screwed into an arm [2] of the sewing machine and including a presser regulating thumb screw [18], the pressure regulating thumb screw [18] being turned clockwise or counter clockwise for regulating to increase or decrease a pressing force by a presser foot [6], wherein the presser regulating thumb screw [18] comprises a screw body [8] and a fitting member [9] fitted in the screw body [8], the screw body [8] is bored in a central axis thereof to form a small diameter fitting hole [8*a*], a large diameter receiving hole having a diameter larger than that of the fitting hole [8*a*], and a spot facing part [8*c*] extending from the large diameter hole [8*b*] having a diameter larger than that of the large diameter hole [8*b*], the small diameter fitting hole [8*a*], the large diameter fitting hole [8*b*] and the spot facing part [8*c*] are arranged in an ascending order, and wherein the fitting member [9] is fixed to the spot facing part [8*c*] so as not to turn relative to the spot facing part [8*c*], and the fitting member [9] has a fitting part [9*b*], the fitting part [9*b*] having a different shape other than a circular shape in cross section.

3 Claims, 5 Drawing Sheets

[ Fig. 1 ]
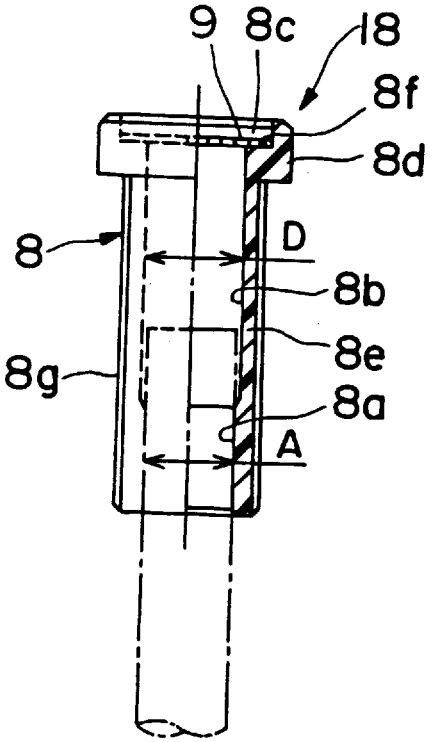
[ Fig. 2 ]
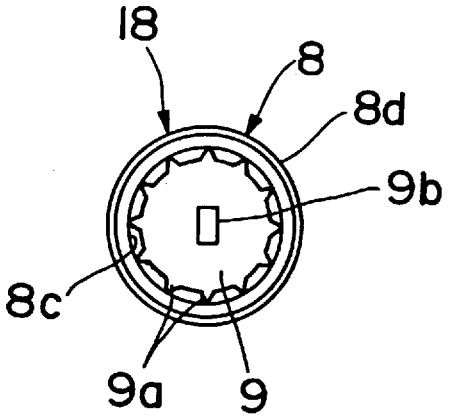

[ Fig. 3 ]
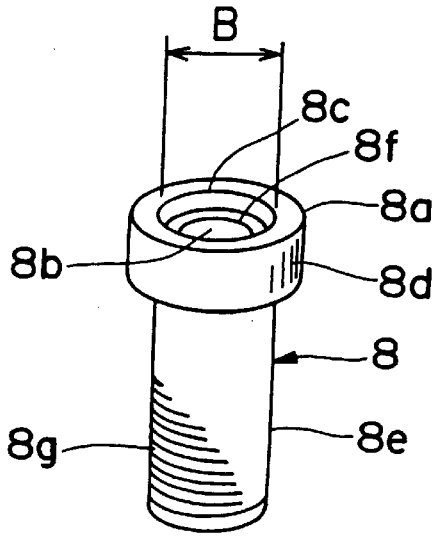
[ Fig.4 ]
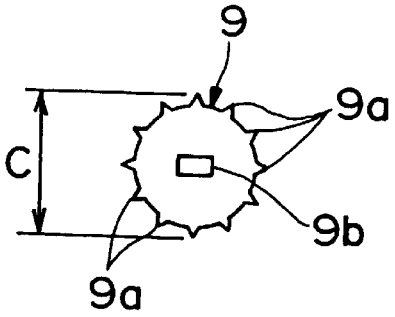
[ Fig.5 ]
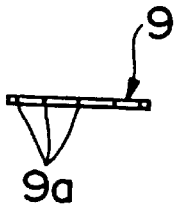

H7-262489
[ Fig. 6 ]
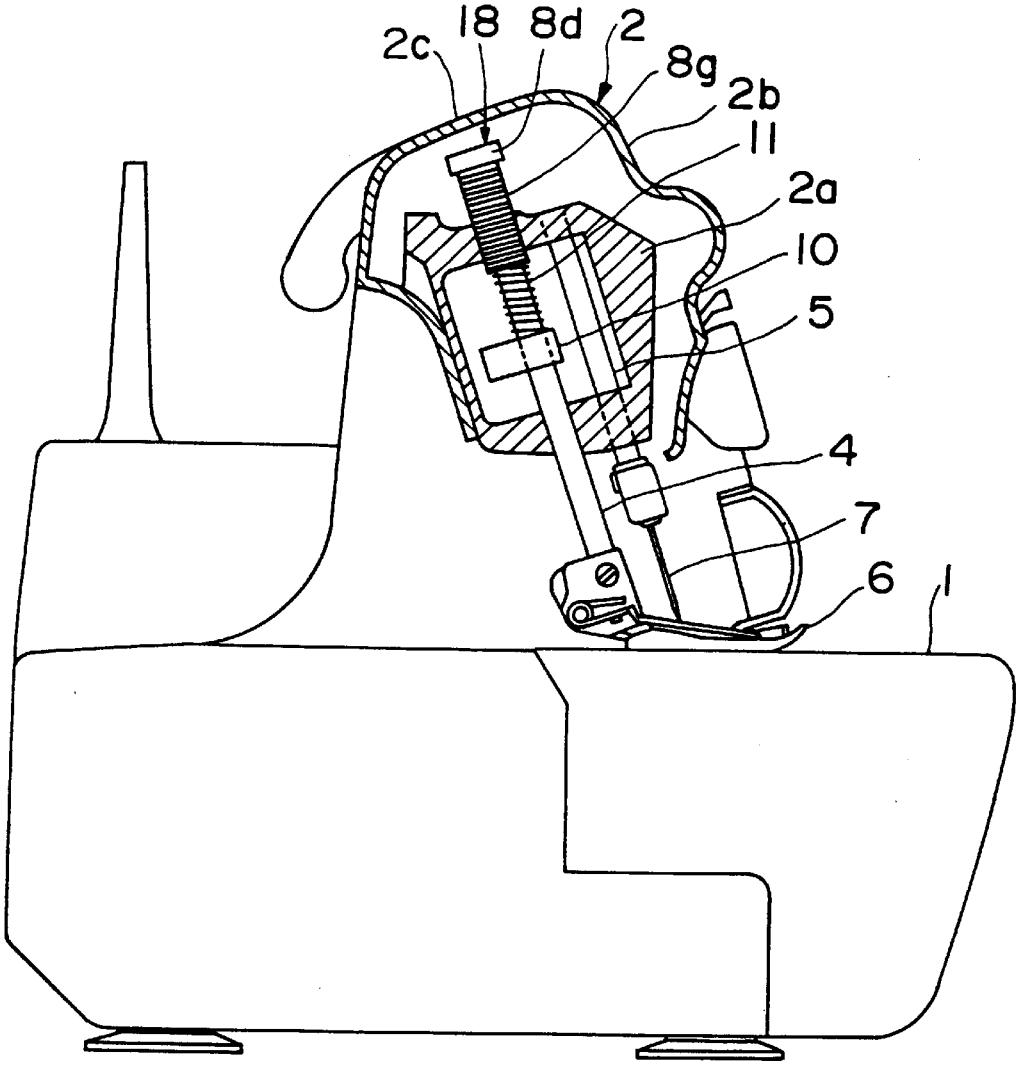

[ Fig. 7 ]
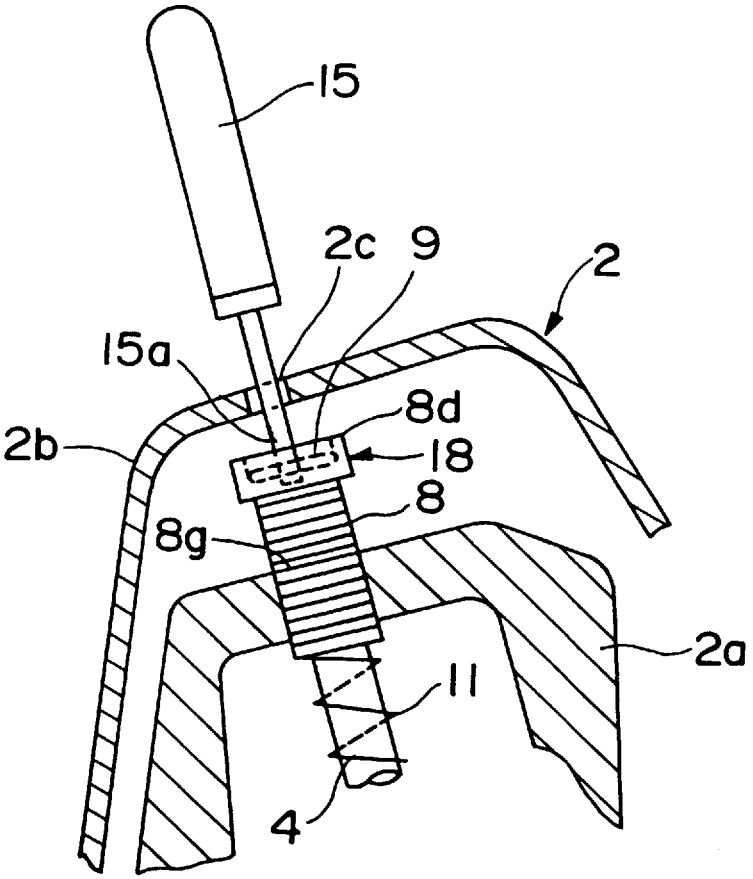

[ Fig. 8 ]
PRIOR ART
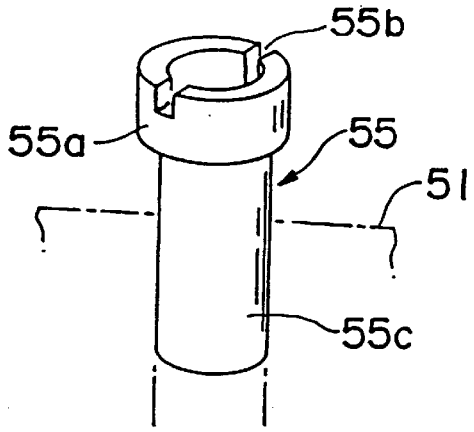
[ Fig.9 ]
PRIOR ART
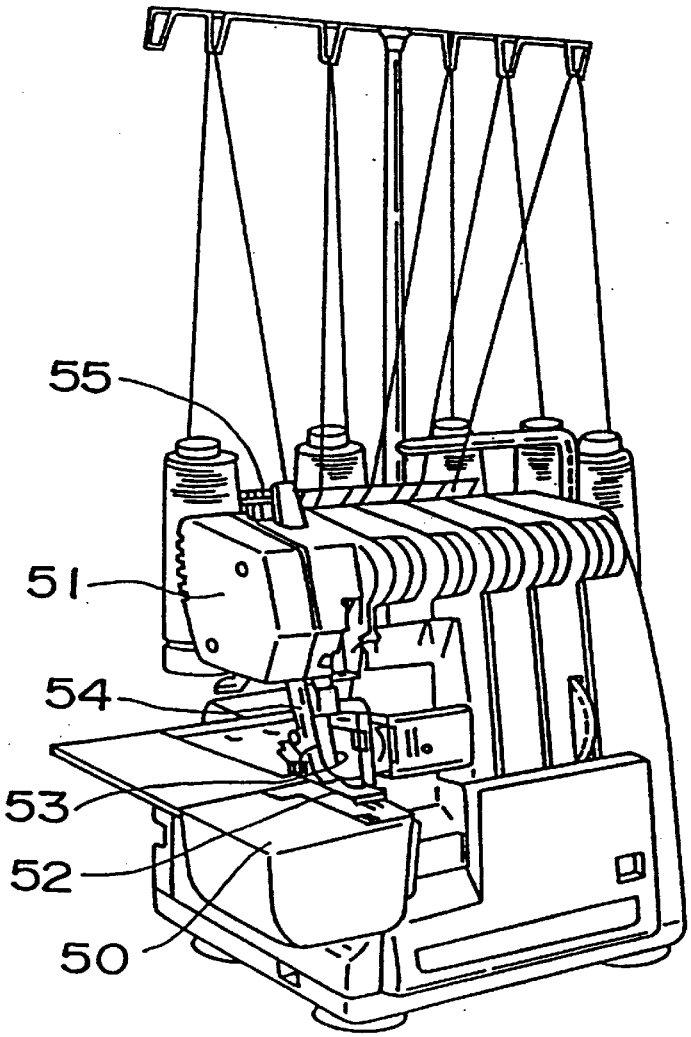

PRESSER REGULATING THUMB SCREW DEVICE OF A SEWING MACHINE

BACKGROUND OF THE INVENTION

1. Field of the Invention

The present invention relates to a presser regulating thumb screw device of a sewing machine.

2. Prior Art

As a presser regulating thumb screw device of a sewing machine, there is known for example, a presser regulating thumb screw device for an overlock sewing machine shown in FIG. 9. In the figure, denoted by 50 is a bed of a sewing machine, 51 is an arm of a sewing machine, 52 is a presser foot, and 53 is a needle. The presser foot 52 is fixed to a presser bar 54, and a presser regulating thumb screw 55 is disposed on the upper end of the presser bar 54. The presser regulating thumb screw 55 is fixed to the bed 51 of the sewing machine by screwing a male portion 55*c* thereof to a female portion of the arm 51 of the sewing machine, wherein a head 55*a* formed at the upper end of screw 55 protrudes outward from the upper surface of the arm 51. The head 55*a* is a slotted head, namely, slotted grooves 55*b* are formed therein so as to extend radially as shown in FIG. 8.

In this sewing machine, a pressure by the presser foot 52, i.e., a pressure for pressing a material to be sewn (workpiece), not shown, onto the bed 50 of the sewing machine is adjusted as follows. Namely, the presser regulating thumb screw 55 is turned clockwise or counterclockwise manually or by the use of a coin or a special instrument inserted into the slotted grooves 55*b*. Thus, the presser regulating thumb screw 55 screwed into the female portion of the arm 51 of the sewing machine is screwed in or screwed out, thereby extending or contracting a presser bar spring (not shown) interposed in a pressed state between the presser regulating screw 55 and the presser bar 54. In this manner, the force to press the workpiece downward by the presser bar 54 which receives repulsive force of the presser bar spring and by the presser foot 52 is adjusted to increase or to decrease, thereby adjusting the pressing force.

However, the prior art presser regulating thumb screw device of a sewing machine has following technical problems.

That is, the presser regulating thumb screw 55 has to maintain a smooth operation of the presser bar 54 by forming a through hole comprising a little diameter hole and a large diameter hole extending in the central axial direction thereof in an ascending order, and receiving the upper end of the presser bar 54 into this through hole so as to be slidable therein, and supporting the presser bar 54 by the small diameter hole alone. Because of this, it is hardly avoidable that the large diameter hole is open at the head 55*a* at the upper end of the presser regulating thumb screw 55. This is caused by the fact that it is not easy to define a large diameter hole in the intermediate portion of the presser regulating thumb screw 55 in the axial direction thereof. As a result, the slotted grooves 55*b* at the upper end are formed of a pair of grooves having a large distance therebetween.

Therefore, a usable instrument that can fit the slotted grooves 55*b* is limited, which makes it impossible to use a general instrument having an operation part of a narrow width such as a driver, etc. In addition, since the top 55*a* of the presser regulating thumb screw 55 must protrude outward from the upper surface of the arm 51 of the sewing machine, the workpiece and a sewing thread are liable to be caught by the protrusion, which interrupts sewing operability and restricts designing of the upper part of the sewing machine.

[Means to Solve the Problems]

The present invention has been made to solve such technical problems of the prior art presser regulating thumb screw device and comprises as follows.

A presser regulating thumb screw device of a sewing machine according to a first aspect of the invention comprises a presser regulating thumb screw device of a sewing machine screwed into an arm 2 of a sewing machine and including a presser regulating thumb screw 18, the presser regulating thumb screw 18 being turned clockwise or counterclockwise for regulating to increase or decrease a pressing force by a presser foot 6, wherein the presser regulating thumb screw 18 comprises a screw body 8 and a fitting member 9 fitted in the screw body 8, the screw body 8 is bored in a central axis thereof to form a small diameter fitting hole 8*a*, a large diameter receiving hole 8*b* having a diameter larger than that of the fitting hole 8*a* and a spot facing part 8*c* extending from the large diameter receiving hole 8*b* having a diameter larger than that of the large diameter receiving hole 8*b*, the small diameter fitting hole 8*a*, the large diameter receiving hole 8*b* and the spot facing part 8*c* are arranged in an ascending order, and wherein the fitting member 9 is fixed to the spot facing part 8*c* so as not to turn relative to the spot facing part 8*c*, and the fitting member 9 has a fitting part 9*b*, the fitting part 9*b* having a different shape other than a circular shape in cross section.

A presser regulating thumb screw device of a sewing machine according to a second aspect of the invention comprises a presser regulating thumb screw device of a sewing machine according to claim 1, wherein the fitting member 9 is discoidal and has a plurality of protrusions 9*a* at a given interval on an outer periphery thereof in a circumferential direction, and the spot facing part 8*c* is formed of a circular hole, and wherein the fitting member 9 is pressed and fixed to the spot facing part 8*c* in a state where each protrusion 9*a* is deformed.

A presser regulating thumb screw device of a sewing machine according to a third aspect of the invention comprises a presser regulating thumb screw device of a sewing machine according to claim 1 or 2, wherein the arm 2 of the sewing machine comprises an arm cover 2*b* covering an upper outer side of the arm body 2*a* of the sewing machine, the presser regulating thumb screw 18 is screwed into the arm body 2*a* of the sewing machine, and wherein the arm cover 2*c* has a through hole 2*c* through which an instrument is inserted at a part thereof corresponding to the presser regulating thumb screw 18.

According to the first aspect of the invention, the force to press the workpiece on the bed of the sewing machine by the presser foot 6 is regulated as follows. Namely, the tip end of an instrument (e.g. a driver) is fitted in the fitting part 9*b* of the fitting member 9. When the instrument is turned clockwise or counterclockwise in this state, the screw body 8 is turned via the fitting member 9 pressed in and fixed to the spot facing part 8*c*, and the presser regulating thumb screw 18 screwed by the male screw 8*g* is screwed into or out of the arm 2 of the sewing machine. The downward pressure of the presser foot 6, i.e., the pressing force against the bed 1 of the sewing machine by the presser foot 6 is regulated to be increased or decreased owing to the movement of the presser regulating thumb screw 18 when it is screwed into or out of the arm 2 of the sewing machine. Since the spot facing part 8*c* is formed in a state that the receiving hole 8*b* is open, the screw body 8 can be integrally formed of synthetic resin and can be comprised of the fitting hole 8*a* and the receiving hole 8*b* which is provided at the intermediate portion thereof and is larger than the fitting hole 8*a* in a diameter thereof.

According to the second aspect of the invention, since the fitting member 9 is pressed in and fixed to the spot facing part 8*c* of the screw body 8 so as not to turn relative to the spot facing part 8*c* and not to be pulled out, the fitting member 9 and the spot facing part 8*c* of the screw body 8 can be easily manufactured, and pressing operation of the fitting member 9 can be easily done, and the fitting member 9 is difficult to be deformed or pulled out when pressing force is repeatedly regulated.

According to the third aspect of the invention, the tip end of the instrument (driver) is inserted from the through hole 2*c* of the arm cover 2*b*, and the tip end of the instrument is fitted in the fitting portion 9*b* of the fitting member 9. In this state, when the instrument is turned clockwise or counterclockwise, presser of presser foot 6 against the bed 1 of the sewing machine is regulated to be increased or decreased.

BRIEF DESCRIPTION OF THE DRAWINGS

FIG. 1 is a half cross sectional view showing a presser regulating thumb screw device of a sewing machine according to a first embodiment of the present invention;

FIG. 2 is a plan view of the presser regulating thumb screw device in FIG. 1;

FIG. 3 is a perspective view showing a main portion of a screw body of the presser regulating thumb screw device in FIG. 1;

FIG. 4 is a plan view of a fitting member of the presser regulating thumb screw device in FIG. 1;

FIG. 5 is a side view of a fitting member in FIG. 4;

FIG. 6 is a side view of a sewing machine employing the presser regulating thumb screw device in FIG. 1, wherein a part of the mechanism is cut off;

FIG. 7 is a view explaining an operation of the presser regulating thumb screw device in FIG. 1 and an instrument;

FIG. 8 is a view showing a prior art presser regulating thumb screw device of a sewing machine; and FIG. 9 is a perspective view showing a prior art sewing machine.

PREFERRED EMBODIMENT OF THE INVENTION

A preferred embodiment of the present invention will be described with reference to FIGS. 1 to 7.

FIGS. 1 to 7 show a preferred embodiment applied to a presser regulating thumb screw device of an overlock sewing machine. In FIG. 6, denoted by 1 is a bed of a sewing machine, in which an arm 2 of the sewing machine is positioned above the bed 1 of the sewing machine. A presser bar 4 and a needle bar 5 are provided to hang from the arm 2 of the sewing machine. A presser foot 6 is attached detachably to the lower end portion of the presser bar 4, and a needle 7 is attached detachably to the lower end portion of the needle bar 5. A presser bar guide bracket 10 is provided at the intermediate portion of the presser bar 4, and a presser regulating thumb screw 18 is disposed at the upper end of the presser bar 4. The arm 2 of the sewing machine comprises an arm body 2*a* thereof and an arm cover 2*b* (for example, an upper cover) firmly fixed to the arm body 2*a* of the sewing machine, wherein the arm cover 2*b* covers the outer upper surface of the arm body 2*a* of the sewing machine as shown in FIGS. 6 and 7.

The presser regulating thumb screw 18 comprises a screw body 8 integrally formed of synthetic resin and a fitting member 9. The screw body 8 has a large diameter head 8*d* formed at the upper end thereof and a small diameter shaft part 8*e* which are arranged coaxially. A through hole comprising a small diameter (having diameter A) fitting hole 8*a* (having diameter B), an intermediate diameter (having diameter D) receiving hole 8*b* (having diameter B), and a large diameter (having diameter B) spot facing part 8*c* (having diameter B) are bored in the screw body 8 in a direction of the central axis thereof and arranged in an ascending order from the lower end of a shaft part 8*e* as shown in FIGS. 1 and 3. The spot facing part 8*c* is defined at the top end 8*d*, and is connected to the receiving hole 8*b* via an annular step 8*f*. The receiving hole 8*b* is opened in the center of the large diameter (diameter B) spot facing part 8*c* (having diameter B). A male screw portion 8*g* is formed on the outer surface of the axial part 8*e*.

The fitting member 9 shown in FIGS. 4 and 5 is fixed in the spot facing part 8*c* of the screw body 8. The fitting member 9 is made of a thin metal sheet and is discoidal, and has the tips of protrusions 9*a* on an outer periphery thereof at a given interval in a circumferential direction, and also has a fitting part 9*b* having a different shape other than a circle (rectangular through hole in the embodiment) in cross section in the center thereof. The fitting part 9*b* is preferable to be made smaller than the intermediate diameter receiving part 8*b* (having diameter D) of the screw body 8. The diameter C extending between opposite tips of protrusions 9*a* of the fitting member 9 is designed to be slightly larger than the diameter B of the spot facing part 8*c*. Thus, the fitting member 9 is pressed into the spot facing part 8*c* of the screw body 8 while each protrusion 9*a* is collapsed by the spot facing part 8*c* so as not to turn relative to the spot facing part 8*c* and not to be pulled out, and is brought into contact with the annular step 8*f*.

Such a presser regulating thumb screw 18 is fixed to the arm body 2 of the sewing machine by screwing the male screw portion 8*g* thereof into a female screw portion penetrating the arm body 2 of the sewing machine, and the upper end of the presser bar 4 is slidably received into the fitting hole 8*a* defined at the lower end. Since a relation between the diameter D of the receiving hole 8*b* of the screw body 8 and the diameter A of the fitting hole 8*a* is expressed by the diameter D>the diameter A as mentioned above, the slide guiding part for supporting the presser bar 4 is limited only to the fitting hole 8*a* and the upper end of the presser bar 4 is idly inserted into the receiving hole 8*b* as shown in FIG. 1. Thereby, the presser bar 4 is prevented from being rubbed with the screw body 8, and a smooth operation (up and down movement) of the presser bar 4 is secured.

A presser bar spring 11 is interposed in a pressed state between the presser bar guide bracket 10 provided at the outer periphery of the intermediate portion of the presser bar 4 and the lower end surface of the screw body 8. A presser bar lifter not shown, is connected to the presser bar guide bracket 10, and the presser bar 4 and the presser foot 6 can be moved up and down thereby. In this state where the presser regulating thumb screw 18 is fixed to the arm body 2*a* of the sewing machine, the head 8*d* of the screw body 8 is positioned inside the arm cover 2*b* although it protrudes outward from the upper surface of the arm body 2*a* of the sewing machine. The arm cover 2*b* has a circular through hole 2*c* through which an instrument is inserted and which is positioned corresponding to the presser regulating thumb screw 18, namely, the through hole 2*c* is positioned on the line extending from the common central axis of the presser bar 4, the pressing spring 11, and the presser regulating thumb screw 18.

An operation of the presser regulating thumb screw device of the sewing machine will be described next.

A pressing force to press a workpiece, not shown, against the bed 1 of the sewing machine by the presser foot 6 is regulated as follows. That is, the tip end of a minus-shaped driver 15 is inserted through the through hole 2*c* of the arm cover 2*b* as shown in FIG. 7, and the tip end 15*a* of the driver 15 is fitted in the fitting part 9*b* of the fitting member 9. When the driver 15 is turned clockwise or counterclockwise in this state, the screw body 8 is turned via the fitting member 9 pressed in and fixed to the spot facing part 8*c*, and the presser regulating thumb screw 18 screwed by the male screw 8*g* is screwed into or out of the arm body 2*a* of the sewing machine. Accordingly, the deflection amount of the pressing spring 11 is increased or decreased, the downward pressing force of the presser foot 6 receiving a repulsive force of the presser bar spring 11 via the presser bar 10 and the presser bar 4 is varied. As a result, the pressing force by the presser foot 6 against the bed 1 of the sewing machine is regulated to be increased or decreased.

Since the fitting member 9 is pressed in and fixed to the spot facing part 8*c* of the screw body 8 so as not to turn relative to the spot facing part 8*c* and not to be pulled out, the fitting member 9 and the spot facing part 8*c* of the screw body 8 can be easily manufactured, and pressing work of the fitting member 9 can be easily done, and the fitting member 9 is difficult to be deformed or pulled out owing to the repetitive regulation of the pressing force by the presser regulating thumb screw 18. If the fitting part 9*b* comprising the through hole of the fitting member 9 is made smaller than the intermediate diameter receiving hole 8*b* (having diameter D), the tip end 15*a* of the driver 15 can be inserted into the receiving hole 8*b* without any obstacle, thereby making the fitting member 9 comparatively thin, so that the tip end 15*a* of the driver 15 can be fitted surely into the fitting part 9*b*.

In the above embodiment, the discoidal fitting member 9 made of a metal is pressed into the circular spot facing part 8*c* of the screw body 8 made of synthetic resin, and each protrusion 9*a* is bit into the peripheral surface of the spot facing part 8*c* of the screw body 8 so as not to turn relative to the spot facing part 8*c* and not to be pulled out. However, if the spot facing part 8*c* is formed as a hole having a different shape in cross section other than a circle, and the fitting member 9 having a shape to fit in the spot facing part 8*c* is fixed by means of pressing, etc., so that the relative turning of the fitting member 9 can be prevented still better. In this case, the fitting member 9 can be bonded with a bonding agent to the spot facing part 8*c* so as to mainly prevent the fitting member 9 from being pulled out. Meanwhile, the spot facing part 8*c* must be formed in a state that the whole upper portion of the receiving hole 8*b* is opened in the same manner as the present embodiment. Thus, it is possible to avoid restriction of the mold which is used when the screw body 8 is integrally formed of synthetic resin.

As is understood with the foregoing description, the following effects can be obtained by the present invention.

That is, in view of the fact that the presser regulating thumb screw 18 is formed of a synthetic resin, the screw body is bored to form the small diameter fitting hole, the larger diameter receiving hole which is larger than the fitting hole in a diameter, and the spot facing part which is open to the large diameter receiving hole in an ascending order from the lower end of the screw body, and the fitting member with the fitting part is fixed to the spot facing part so as not to turn relative to the spot facing part. By this, a smooth operation of the presser bar can be assured while securing facility of the structure of the mold, and the pressing force of the presser foot can be regulated by the fitting member having the fitting part using the driver. Further, such presser regulating thumb screw device of the sewing machine can be obtained with low cost and can be simplified in structure.

Further, since the pressing force of the presser foot can be regulated by the driver, the presser regulating thumb screw device of a sewing machine can be disposed inside of the arm cover of the arm of the sewing machine, and the workpiece or the sewing thread is prevented from being caught by the protrusions, thereby eliminating the drawback that the sewing operability is deteriorated. Still further, the through hole through which an instrument is inserted and which is formed in the arm cover can be so small that the tip end of the driver can pass therethrough, and the external design of the sewing machine can be made clearer.

What is claimed is:

1. A presser regulating thumb screw device of a sewing machine screwed into an arm [2] of a sewing machine and including a presser regulating thumb screw [18], said presser regulating thumb screw [18] being turned clockwise or counterclockwise for regulating to increase or decrease a pressing force by a presser foot [6], wherein said presser regulating thumb screw [18] comprises a screw body [8] and a fitting member [9] fitted in said screw body [8], said screw body [8] is bored in a central axis thereof to form a small diameter fitting hole [8*a*], a large diameter receiving hole [8*b*] having a diameter larger than that of said fitting hole [8*a*] and a spot facing part [8*c*] extending from said large diameter receiving hole [8*b*] having a diameter larger than that of said large diameter receiving hole [8*b*], said small diameter fitting hole [8*a*], said large diameter receiving hole [8*b*] and said spot facing part [8*c*] are arranged in an ascending order, and wherein said fitting member [9] is fixed to said spot facing part [8*c*] so as not to turn relative to said spot facing part [8*c*], and said fitting member [9] has a fitting part [9*b*], said fitting part [9*b*] having a different shape other than a circular shape in cross section.

2. A presser regulating thumb screw device of a sewing machine according to claim 1, wherein said fitting member [9] is discoidal and has a plurality of protrusions [9*a*] at a given interval on an outer periphery thereof in a circumferential direction, and said spot facing part [8*c*] is formed of a circular hole, and wherein said fitting member [9] is pressed in and fixed to said spot facing part [8*c*] in a state where each protrusion [9*a*] is deformed.

3. A presser regulating thumb screw device of a sewing machine according to claim 1 wherein said arm [2] of said sewing machine comprises an arm cover [2*b*] covering an upper outer side of said arm body [2*a*] of said sewing machine, said presser regulating thumb screw [18] is screwed into said arm body [2*a*] of said sewing machine, and wherein said arm cover [2*c*] has a through hole [2*c*] through which an instrument is inserted at a part thereof corresponding to said presser regulating thumb screw [18].

* * * * *